United States Patent [19]

Terazono et al.

[11] 4,072,212

[45] Feb. 7, 1978

[54] ELEVATOR SPEED CONTROL SYSTEM

[75] Inventors: Narihiro Terazono; Hiroshi Kamaike; Shigehiko Suzuki, all of Inazawa, Japan

[73] Assignee: Mitsubishi Denki Kabushiki Kaisha, Tokyo, Japan

[21] Appl. No.: 715,197

[22] Filed: Aug. 17, 1976

[30] Foreign Application Priority Data

Aug. 28, 1975 Japan ..... 50-104315
Aug. 28, 1975 Japan ..... 50-104316

[51] Int. Cl.[2] ..... B66B 1/30
[52] U.S. Cl. ..... 187/29 R; 318/203 R
[58] Field of Search ..... 187/29; 318/203, 204

[56] References Cited

U.S. PATENT DOCUMENTS 3,688,874 9/1972 Lusti et al. ..... 187/29
3,876,918 4/1975 Komuro et al. ..... 318/203
3,941,214 3/1976 Young et al. ..... 187/29
3,973,175 8/1976 Anzai et al. ..... 318/203

*Primary Examiner*—Robert K. Schaefer
*Assistant Examiner*—W. E. Duncanson, Jr.
*Attorney, Agent, or Firm*—Wenderoth, Lind & Ponack

[57] ABSTRACT

The disclosed elevator speed control system accelerates an induction motor for an elevator car in accordance with a voltage dependent upon a differential signal between a command speed signal and the actual speed signal and passed through a saturation generator. The saturation generator issues a command for applying across the motor its rated voltage upon the closure of a normally open contact set disposed in it. The system includes a sensor circuit is responsive to the difference signal less than a predetermined magnitude to decrease an output from the saturation generator. Alternatively the sensor circuit may responds to a negative load on the motor exceeding a predetermined magnitude to decrease the output from the saturation generator.

5 Claims, 11 Drawing Figures

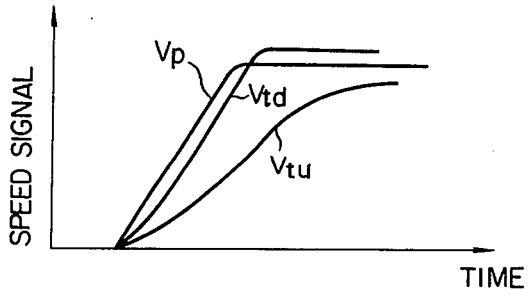
FIG. 6A
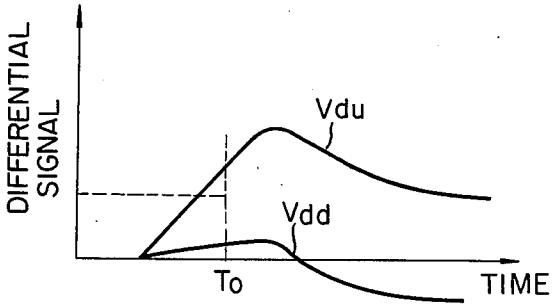
FIG. 6B
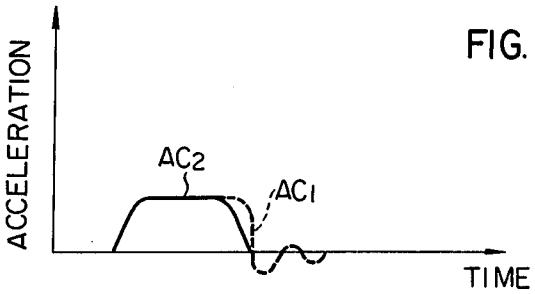
FIG. 6C
FIG. 7
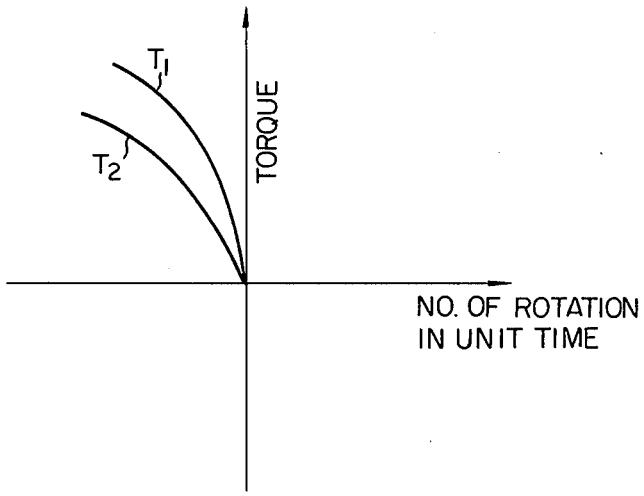

ELEVATOR SPEED CONTROL SYSTEM

BACKGROUND OF THE INVENTION

This invention relates to improvements in an elevator speed control system for controlling a speed of an elevator car driven by an induction motor.

It is well known to control a firing angle of a thyristor device connected across an induction motor and a source of alternating current therefor thereby to control a rotational speed of the induction motor through a change in voltage applied across the motor. In this case, it has been generally practiced to apply an AC voltage controlled by the thyristor device across the induction motor in the power running mode of operation and to apply a DC voltage controlled by a separate thyristor device across the motor in the braking mode of operation.

There have been already proposed elevator control systems of the type utilizing the measure as above described to control a speed of an elevator car involved through the negative feedback control during the acceleration and deceleration of the car. Up to the deceleration of the car after the completion of the acceleration thereof, the travel of the car is effected by applying across an associated electric motor its rated voltage in order to decrease a quantity of heat generated and an electric power consumed by the motor.

The load on elevator systems can be of either a positive or a negative polarity as determined by a difference in weight between the particular elevator car and a counterweight therefor. The term "positive polarity" refers to the case an associated electric motor is required to produce a power running torque to bear a load involved while the term "negative polarity" refers to the case the electric motor should produce a braking torque to bear the load. For example, a load having a negative polarity can be caused when the elevator car is downwardly travelling with its full load. With the elevator car being accelerated under negative polarity loading the operation may be transferred to the braking mode midway of the acceleration. If, under these circumstances, the motor is applied with its rated voltage at the end of the acceleration then a large shock occurs when the operation changes from the braking mode to the rated voltage mode. This much injures a feeling of riding in an elevator car driven by the motor. In order to avoid this objection, there have been previously proposed elevator control systems of the type including means for gradually giving a command for the application of the rated voltage (which is called hereinafter a command for saturation) midway of the acceleration of the particular elevator car so as not to transfer the operation to the braking mode between the initiation of the acceleration of the car and the travel of the car at its rated speed even under negative polarity loading. However this type of elevator control systems has been disabled to effect the speed control upon the completion of the acceleration of the car because of the presence of a saturation signal originating from the command for saturation as above described. This has resulted in the disadvantage that a feeling of riding in the elevator car is made worse particularly under negative polarity loading because the feeling of riding in the elevator car upon the completion of the acceleration thereof is determined by the characteristics of the associated electric motor.

SUMMARY OF THE INVENTION

It is a general object of the present invention to eliminate the disadvantages of the prior art practice as above described.

It is an object of the present invention to provide a new and improved elevator speed control system for controlling a speed of an elevator car so as to decrease shocks occurring in the elevator car and prevent the comfortableness in the car from impairing upon the completion of the acceleration of an associated induction motor driving a negative polarity load even with a command for saturation applied to the system.

The present invention accomplishes these objects by the provision of an elevator speed control system comprising, in combination, an elevator car and a counterweight connected to both ends of a traction rope respectively, a hoist sheave having the traction rope trained thereover, an induction motor for driving the hoist sheave to vertically move the elevator car and the counterweight in the opposite directions, and means for applying to the induction motor a voltage dependent upon a differential signal between a command speed signal for the motor and a speed signal representative of the actual speed of the motor thereby to accelerate the induction motor, and applying across said induction motor a rated voltage thereof after the completion of the acceleration of the motor, wherein there is provided a sensor circuit for sensing a negative polarity load on the induction motor to limit the voltage applied across the induction motor through the operation of the sensor circuit.

Preferably, the sensor circuit may be operative in response to the differential signal developed during the acceleration of the motor and less than a predetermined magnitude. Alternatively the sensor circuit may be operative in response to a load on the induction motor having a negative polarity and exceeding a predetermined magnitude.

BRIEF DESCRIPTION OF THE DRAWINGS

The present invention will become more readily apparent from the following detailed description taken in conjunction with the accompanying drawings in which:

FIGS. 6A through 6C are graphs plotting signals developed at various points in the arrangement shown in FIGS. 1 through 5 as functions of time;

FIG. 7 is a graph illustrating the relationship between a torque of an induction motor and the number of rotation in unit time thereof;

DESCRIPTION OF THE PREFERRED EMBODIMENTS

Figure 1:
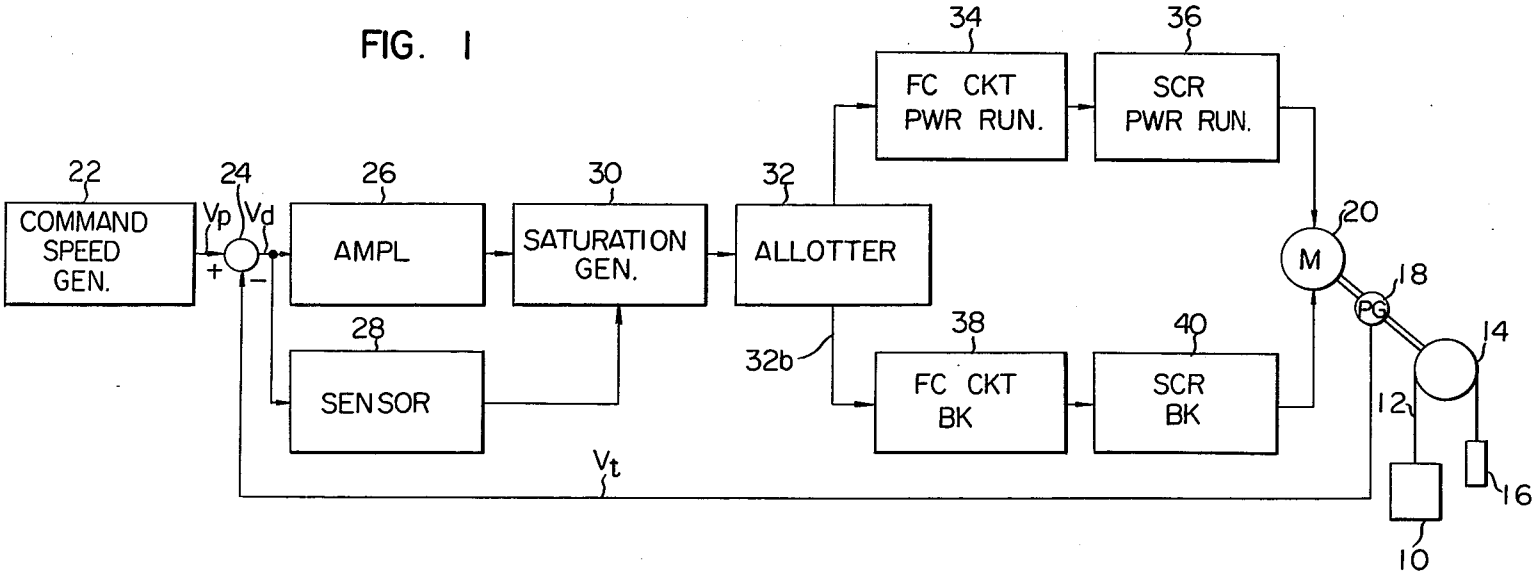
FIG. 1 is a block diagram of an elevator speed control system constructed in accordance with the principles of the present invention.

Referring now to the drawings and FIG. 1 in particular, there is illustrated an elevator speed control system constructed in accordance with the principles of the present invention. The arrangement illustrated comprises an elevator car 10, a traction rope 12 connected at one end to the elevator car 10 and trained over a hoist sheave 14 and a counterweight 16 connected to the traction rope 12 at the other end. A tachometer generator 18 is operatively coupled to an induction motor 20 for driving the elevator car 10 in one or the other of the opposite directions through the hoist sheave 14. The tachometer generator 18 is operative to generate the actual speed signal $V_t$ proportional to the actual speed of the motor 20 and therefore the car 10.

As shown in FIG. 1, a command signal generator 22 for generating a command speed signal $V_p$ for the elevator car is connected to a subtractor 24 to which the tachometer generator 18 is also connected. The subtractor 24 is adapted to be applied with the command speed signal $V_p$ with a positive polarity and also with the actual speed signal $V_t$ with a negative polarity to provide a differential signal $V_d$ between both signals. The differential signal $V_d$ from the subtracter 24 is applied to both an amplifier 26 with the time delay characteristic and a sensor circuit 28 according to the principles of the present invention. The amplifier and sensor circuit 26 and 28 respectively have respective outputs connected to a saturation signal generator 30 subsequently connected to an allotter circuit 30.

The sensor circuit 28 is responsive to the differential signal $V_d$ from the subtracter 24 less than a predetermined magnitude to produce an output as will be described in more detail hereinafter. The saturation generator 30 is operative to issue a command for saturation required for applying across the induction motor 20 its rated voltage after the completion of the acceleration of the motor 20 and therefore the car 10 and in spite of the output from the amplifier 26. The saturation generator 30 is also operative to render the command for saturation null upon the initiation of the deceleration of the motor 20 and accordingly the car 10. The allotter circuit 32 is adapted to produce an output 32*a* for a positive differential signal $V_d$ and an output 32*b* for a negative signal $V_d$.

As shown in FIG. 1, the output 32*a* from the allotter circuit 32 is connected to a firing control circuit 34 subsequently connected to the induction motor 20 through a thyristor device 36. On the other hand, the output 32*b* from the allotter circuit 32 is connected to another firing control circuit 38 subsequently connected to the induction motor 20 through another thyristor device 40. In the power running mode of operation the firing control circuit 34 is responsive to the output 32*a* from the allotter circuit 32 to control a firing angle of the thyristor device 36 to apply a phase controlled AC voltage to the motor 20. In the braking mode of operation, however, the firing conrol circuit 38 is responsive to the output 32*b* from the allotter circuit 32 to control a firing angle of the thyristor device 40 to apply a phase-controlled DC voltage to the motor 20.

Figure 2:
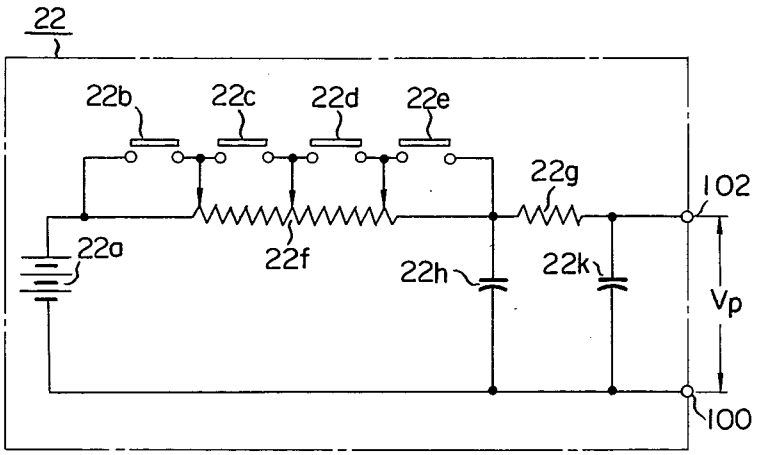
FIG. 2 is a circuit diagram of the command speed generator shown in FIG. 1.

The command speed generator 22 can have a circuit configuration as shown in FIG. 2. As shown, the generator 22 comprises a source of direct current 22*a* having a negative side connected to a negative terminal 100 and a positive side connected to a plurality of sets of normally open contacts 22*b*, 22*c*, 22*d* and 22*e* serially interconnected. The series combination of those contact sets is connected across a resistor 22*f* and also connected to a positive terminal 102 through a resistor 22*g* with the junctions of adjacent contact sets connected to intermediate movable taps on the resistor 22*f*. The junction of the resistors 22*f* and 22*g* is connected through a capacitor 22*h* to the negative terminal 100 while the resistor 22*g* and therefore the positive terminal 102 is connected to the terminal 100 through a capacitor 22*k*.

In order to accelerate the induction motor 20 and hence the elevator car 10, the sets of normally open contacts 22*b*, 22*c*, 22*d* and 22*e* are closed one after another to divide a voltage across the source 22*a* thereby to cause the source 22*a* to produce a stepwise increased signal. This stepwise increases signal passes through and smoothed by a filter circuit formed of the resistors 22*f* and 22*g* and the capacitors 22*h* and 22*k* to form a continuously increased signal that appears across the terminals 102 and 100 as a command speed signal $V_p$ instructing the acceleration of the motor 20.

When the motor 20 is desired to be decelerated, the sets of now closed contacts 22*b*, 22*c*, 22*d* and 22*e* are successively opened. Thus the source similarly produces a stepwise decreased signal which is, in turn, smoothed by the filter circuit 22*f*-22*g*-22*h*-22*k*. As a result, a continuously decreased command speed signal $V_p$ is developed across the terminals 102 and 100 to instruct the deceleration of the motor 20 and therefore the elevator car 10.

As above described, the command speed signal $V_p$ thus produced is applied to the subtractor 24. The subtractor 24 can be of a circuit configuration generally designated by the reference numeral 24 in FIG. 3.

Figure 3:
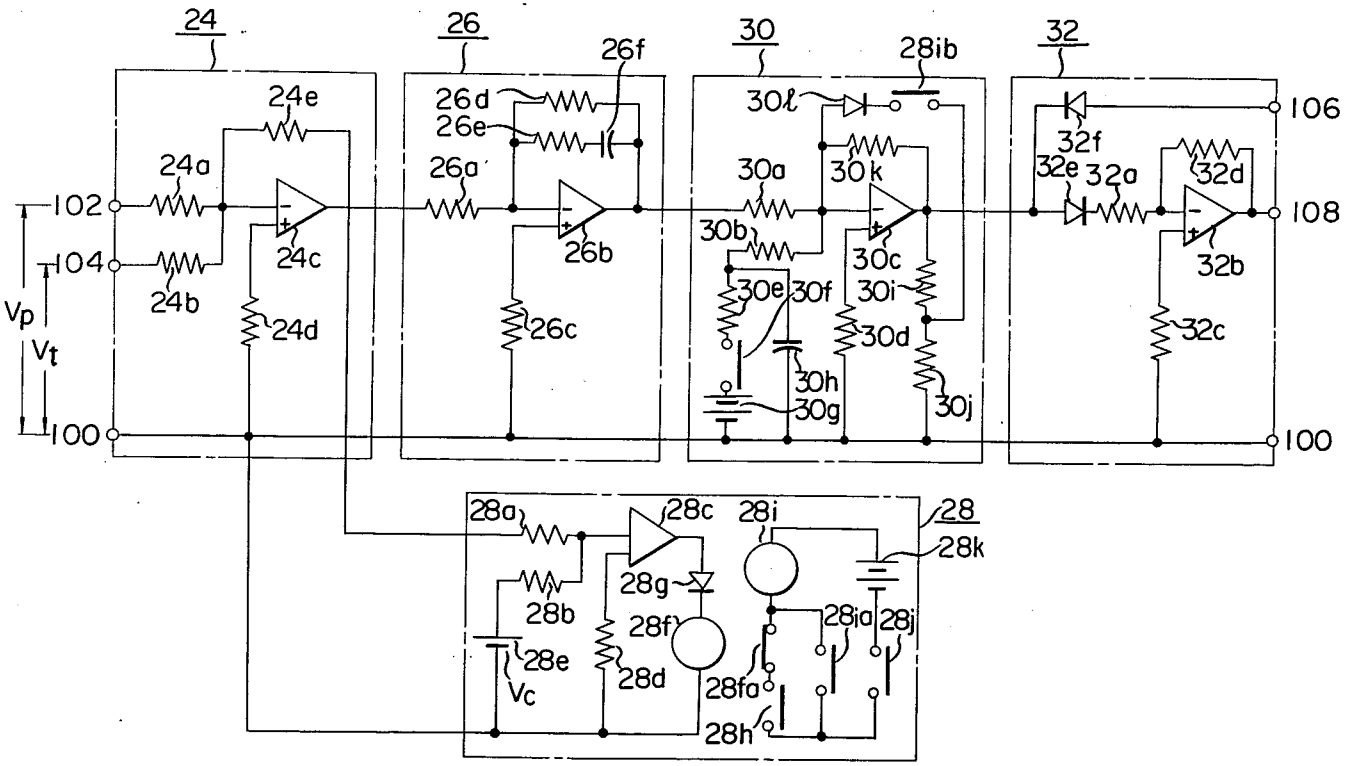
FIG. 3 is a circuit diagram of the substracter, amplifier, sensor, saturation signal generator and allotter shown in FIG. 1.

As shown in FIG. 3, the command speed signal $V_p$ from the command speed generator 22 is applied across a pair of terminals 102 and 100 while the actual speed signal $V_t$ from the tachometer generator 18 (see FIG. 1) is applied across a pair of terminals 104 and 100. The terminals 102 and 104 are connected to respective resistors 24*a* and 24*b* connected together to a negative input to an operational amplifier 24*c* having a positive input connected to the terminal 100 through a resistor 24*d*. The operational amplifier 24*c* includes also a feedback resistor 24*e* connected between the negative input and an output thereof.

The output of the operational amplifier 24*c* is connected to a resistor 26*a* in the amplifier 26 having the delay characteristic. The amplifier 26 is shown in FIG. 3 as including an operational amplifier 26*b* with a feedback network having a negative input connected to the input resistor 26*a* and a positive input connected to the terminal 100 through a resistor 26*c*. The feedback network is composed of a resistor 26*d* connected across a series combination of a resistor 26*e* and a capacitor 26*f* and between the negative input and output of the operational amplifier 26*b*.

The amplifier 26 has a static again as determined by the resistance 26*d* divided by the resistance 26*a* and the frequency characteristics dependent upon magnitudes of the resistors 26*a*, 26*d* and 26*e* and capacitor 26*f*.

The output of the operational amplifier 24*c* in the subtractor 24 is connected to the sensor circuit 28 according to the present invention. The sensor circuit 28 has preferably a circuit configuration generally designated by the reference numeral 28 in FIG. 3. As shown, the sensor circuit 28 includes a pair of resistors 28*a* and 28*b* connected together to a negative input to an operational amplifier 28c having a positive input connected to the negative terminal 100 through a resistor 28d. The resistor 28a is connected to the output of the operational amplifier 24c in the subtracter 24 and the resistor 28b is connected to the negative terminal 100 through a source of DC voltage 28e. The source 28e has as negative side connected to the terminal 100. The amplifier 28 has an output connected toan energizing winding of a difference sensor relay 28f through a semiconductor diode 28g including an anode connected to the output of the amplifier 28c. Then the relay 28f winding is connected to the negative terminal 100.

The source 28e provides a reference voltage $V_r$ serving to determine a sensing level and the operational amplifier 28c serves as a comparator for comparing the output from the subtractor 24 with a reference voltage $V_r$ across the source 28e. The relay 28f is adapted to be energized in response to the output voltage $V_d$ from the subtractor 24 negative and higher than the voltage $V_r$ across the source 28e, that is to say, when $|V_d| > V_r$ is held. The relay 28f is also adapted to be deenergized when the $V_d$ is negative and $|V_d| \leqq V_r$, that is to say, when the output $V_d$ from the subtracter 24 is positive or negative and has the absolute magnitude equal to or less than the voltage $V_r$ across the source 28e. Thus the relay 28f senses a differential signal having a negative polarity and the absolute magnitude greater than a predetermined magnitude, in this case, the $V_r$ to be energized.

The relay 28f includes a set of normally closed contacts 28fa connected on one side to a set of normally open contacts 28h and on the other side to a winding on an output limiting relay 28i. The set of normally open contact 28h is controlled by a relay (not shown) instantaneously energized sometime during the acceleration of the motor. The relay 28i includes a set of normally open contacts 28ia connected across the serially connected contact sets 28fa and 28h. The relay 28i winding is connected to a set of normally open contacts 28j through a source of direct current 28k. The set of normally open contacts 28j is connected to the contact sets 28ia and 28h and controlled by a running relay (not shown) energized during the travel of the car and deenergized upon the car stopping.

The output of the operational amplifier 26b in the amplifier 26 is connected to a resistor 30a included in the saturation signal generator 30 having a circuit configuration generally designated by the reference numeral 30 in FIG. 3. The resistor 30a is connected to a negative input to an operational amplifier 30c has a positive input connected to the negative terminal 100 through a resistor 30d. The resistor 30d is connected to a series combination of a resistor 30e a set of normally open contacts 30f and a source of direct current 30g connected across a capacitor 30h. The source 30g has a negative side connected to the negative terminal 100 and provides a reference voltage.

The operational amplifier 30c has an output connected to the negative terminal 100 through a pair of serially connected resistors 30i and 30j and also to the negative input thereto through a feedback resistor 30k. The junction of the resistor 30i and 30j is connected to the negative input to the operational amplifier 30c through a set of normally open contacts 28ib and a semiconductor diode 30l serially interconnected with the diode 30l so poled that a current from the resistor 50a is permitted to flow toward the contact set 28ib therethrough.

The normally open contact set 30f is controlled by a relay (not shown) energized sometime during the acceleration of the motor 26 and deenergized upon the initiation of the deceleration of the motor 26. The contact set 28ib is controlled by the output limiting relay 28i.

With the contact set 30f maintained in its open position, the intact output from the amplifier 26 provides an output from the saturation generator 30. However, when the contact set 30f is brought into its closed position midway of the acceleration of the motor, a delay network including the resistors 30b and 30e and the capacitor 30h is operated to apply an output to the operational amplifier 30c to saturate the firing control circuit 34 on the power running side regardless of the output from the amplifier 26 as will be described in detail hereinafter. Also the closure of the contact set 28ib causes the output from the operational amplifier 30c to be limited to a voltage as determined by a ratio of voltage division dependent upon magnitudes of the resistance 30i and 30j.

The allotter circuit 32 having connected to the output of the saturation generator 30 has, for example, a circuit configuration generally designated by the reference numeral 32 in FIG. 3. The allotter circuit 32 comprises a resistor 32a connected to a negative input to an operational amplifier 32b having a positive input connected to the negative terminal 100 through a resistor 32c and including a feedback resistor 32d connected across the negative input and output thereof. The output of the operational amplifier 30c in the saturation generator 30 is connected to the resistor 32a through a semiconductor diode 32f. The diodes 32e and 32f are opposite in polarity to each other so that a positive input to the allotter circuit 32 causes a negative output across an output terminal 108 connected to the output of the operational amplifier 32b and the terminal 100 while a negative input to the circuit 32 causes a negative output across the terminals 106 and 100.

The terminals 106 and 100 are connected to the firing control circuit 34 on the power running side while the terminals 108 and 100 are connected to the firing control circuit 38 on the braking side.

Figure 4:
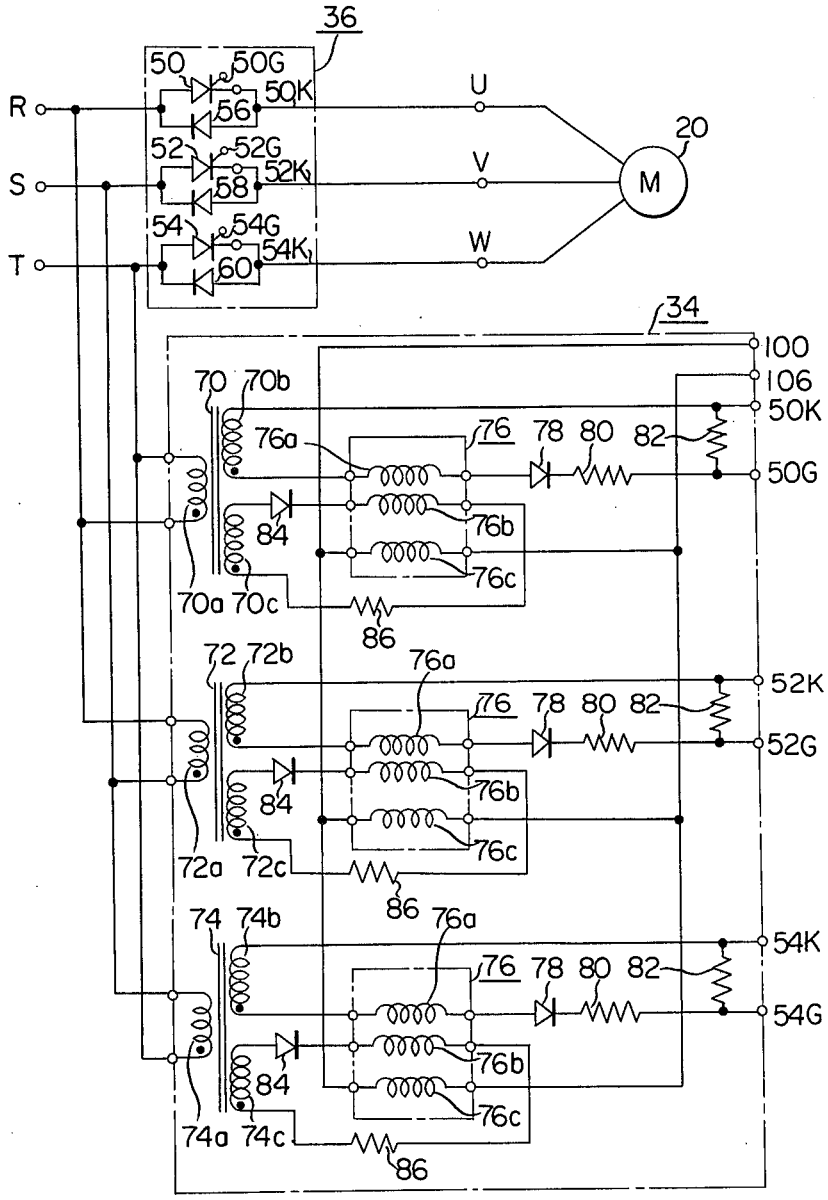
FIG. 4 is a wiring diagram of the thyristor device and firing control circuit on the power running side shown in FIG. 1.

FIG. 4 shows the details of the firing control circuit and thyristor devices 34 and 36 respectively on the power running side. In FIG. 4 the induction motor 20 is shown as being energized by a three-phase AC source R-S-T through the thyristor device 36 and three terminals U V and W thereof. The thyristor device 36 includes one set of a thyristor 50, 52 or 54 and a semiconductor diode 56, 58 or 60 interconnected in anti-parallel relationship with the thyristor for each phase. Each of the thyristors 50, 52 or 54 includes a gate electrodes 50G, 52G or 54G, an anode electrode connected to the conductor R S or T of the AC source and a cathode electrode 50K, 52 K or 54K connected to the associated terminal U, V or W of the motor 20.

The firing control circuit 34 comprises three single-phase transformers 70, 72 and 74 for producing synchronizing signals each including a single primary winding 70a, 72a or 74a and a pair of secondary winding 70b and 70c, 72b and 72c or 74b and 74c. The primary winding 70a is connected across a pair of conductors T and R and the primary winding 72a is connected across a pair of conductors R and S. Similarly the primary winding 74a is connected across a pair of conductors S and T. The three transformers 70, 72 and 74 have the secondary, sides having the same circuit configuration and one of them, for example, a circuit portion for the R phase will now be described in detail with like reference numerals employed to identify the corresponding components of all the three circuit portions.

As shown in FIG. 4, one of the secondary winding 70*b* is connected at one end to the cathode electrode 50K of the thyristor 50 and at the other end to an output winding 76*a* of a magnetic amplifier generally designated by the reference numeral 76. Then the output winding 76*a* is connected to the gate electrode 50G of the thyristor 50 through a semiconductor diode 78 and a resistor 80 with another resistor 82 connected across the cathode and gate electrodes 50K and 50G respectively of the thyristor 50.

Also the dot convention is used to indicate the instantaneous polarity of the transformer windings.

The magnetic amplifier 76 further includes a reset winding 76*b* and a control winding 76*c*. The reset winding 76*b* is connected at one end to one end of the other secondary winding 70*c* through a semiconductor diode 84 and at the other end to the other end of the same winding through a resistor 86. The control winding 76*c* has one end connected to one input terminal or the negative terminal 100 and the other end connected to the other input terminal or the output terminal 106 of the allotter circuit 32.

The diode 78 serves to block a reverse voltage applied to the gate electrode during the reverse bias of the thyristor 50. The resistors 80 and 82 are operative to divide an output from the magnetic amplifier 76 to apply the divided voltage across the gate and cathode electrodes 50G and 50K respectively of the thyristor 50. The diode 84 identical in polarity to the diode 78, the reset winding 76*b* and the resistor 86 form a reset circuit for resetting the saturation of the magnetic amplifier 76 when the thyristor 50 is being reversely biased.

As above described, a power running signal is applied across the input terminals 106 and 100 to form a firing signal with a phase angle proportional to a current flowing through the control winding 76*c* due to the power running signal. This firing signal controls the firing angle of the thyristor 50.

From the foregoing it will be appreciated that the firing angle of the remaining thyristors 52 and 54 is controlled in the same manner as above described by the respective transformers 72 and 74 and the associated firing circuit portions.

Figure 5:
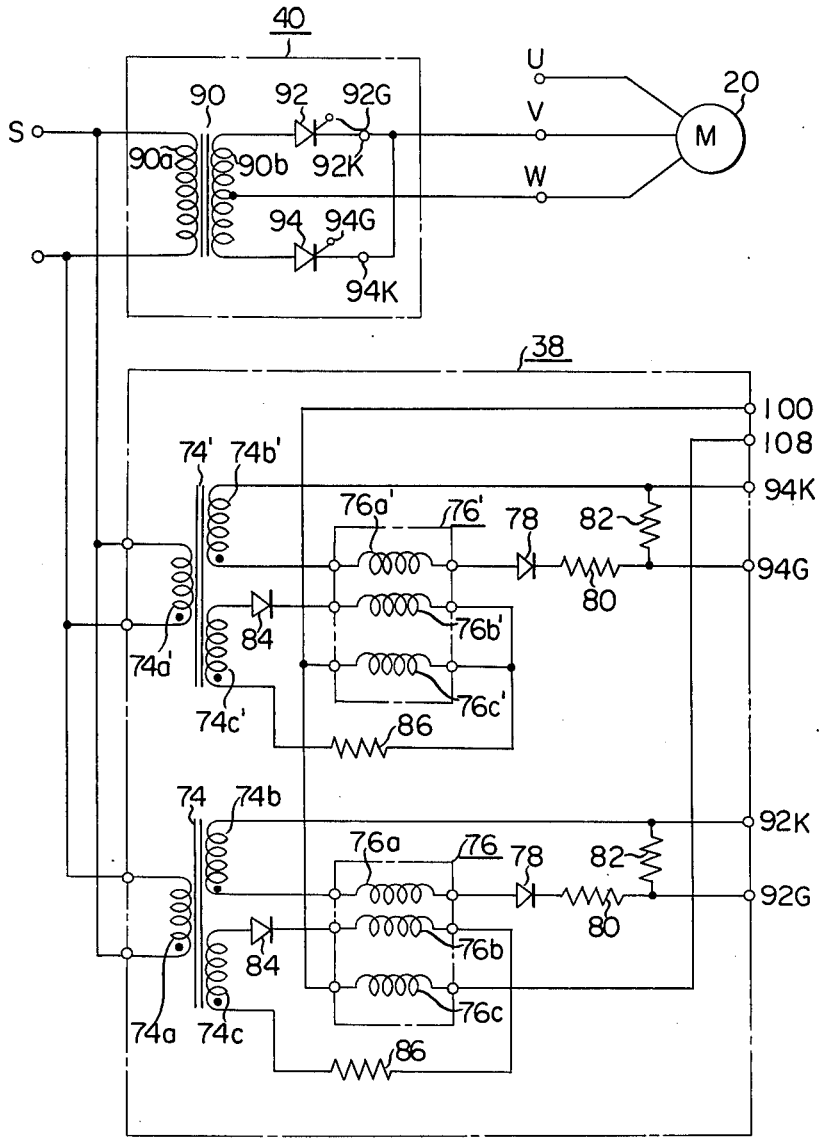
FIG. 5 is a wiring diagram of the thyristor device and firing control circuit on the braking side shown in FIG. 1.

FIG. 5 wherein like reference numerals designate the components corresponding or similar to those shown in FIG. 4 illustrates the firing control circuit and thyristor device 38 and 40 respectively on the braking side. It is noted that FIG. 5 shows only those portions of the thyristor device 40 and the firing control circuit 38 associated with the terminals V and W of the motor 20. However those thyristors and firing control circuits therefor associated to the terminals U and V and the terminals W and U of the motor 20 are omitted only for purposes of illustration because their circuit configurations are the same as those shown in FIG. 5.

In FIG. 5 the thyristor device 40 is shown as comprising a single-phase transformer 90 including a primary winding 90*a* connected across the conductors S and T of the AC source and a center-tapped secondary winding 90*b* connected at both ends to anode electrodes of both thyristor 92 and 94 with the center tap thereon connected to the terminal W of the motor 20. Each thyristor 92 or 94 includes a gate electrode 92G or 94G and a cathode electrode 92K or 94K connected to the terminal V of the motor 20.

A circuit portion shown on the lower portion within dotted and dashed block 38 is identical to that illustrated in the lowermost portion within dotted and dashed block 34 shown in FIG. 4 except for the substitution of the terminal 108 for the terminal 106. That circuit portion controls the firing angle of the thyristor 92. The other thyristor 94 is controlled by another circuit portion shown on the upper portion within block 38 and identical to the circuit portion for the thyristor 94 except for the connection of the primary transformer winding to the source. That is, the primary transformer winding 74*a* included in the upper circuit portion has the dotted end connected to the conductor T of the source while the primary transformer winding 74*a* included in the lower portion has the dotted end connected to the conductor S of the source.

With a command speed signal for braking applied across the terminals 108 and 100 through the allotter circuit 32, a firing signal having a phase angle proportional to the applied signal is developed across each pair of terminals 94G and 94K or 92G and 92K or across the gate and cathode electrodes of each thyristor 94 or 92 in the similar manner as above described in conjunction with the firing control circuit on the power running side shown in FIG. 4. Then the firing signals control the firing of the thyristors 94 and 92.

It is now assumed that the elevator car 10 is under full loading, that is, it bears 80% or more of its rated load. Under the assumed condition, the motor 20 is initiated to be driven so as to travel the car 10 downwardly. This causes the tachometer generator 18 to produce a speed signal $V_t$ representative of the actual speed of the motor 20 and therefore the car 10. The actual speed signal $V_t$ is applied across the terminals 104 and 100 of the subtracter 24 (see FIG. 3). Also a command speed signal $V_p$ for acceleration is generated in the manner as above described in conjunction with FIG. 2 from the command speed generator 22 and applied across the terminals 102 and 100 of the subtracter 24. The subtracter 24 substracts the actual speed signal $V_t$ from the command signal $V_p$ to produce and supply a differential signal $V_d$ to the amplifier 26. Even for a load having a negative polarity, the command signal $V_p$ is greater than the actual signal $V_t$ at the beginning of the acceleration of the motor 20. Thus the operational amplifier 24*c* in the subtracter 24 receives a positive input and produces a negative output. This negative output or differential signal is amplified by the amplifier 26 to provide a positive output that is, in turn, supplied to the saturation generator 30.

On the other hand, one portion of the negative differential signal from the subtracter 24 is supplied to the sensor circuit 28. At that time the reference $V_r$ across the source 28*e* in the sensor circuit 28 is preset to be greater than the absolute magnitude of the output from the subtracter 24. This means that a positive input is applied to the operational amplifier or comparator 28*c* and therefore that the comparator 28*c* produces a negative output. This negative output from the comparator 28*c* is blocked by the diode 28*g* to prevent the energization of the difference sensor relay 28*f*. Thus the relay 28*f* has its contact set 28*fa* remaining in its closed position. In the meanwhile the running contact set 28*j* is maintained in its closed position.

In the saturation generator 30, the operational amplifier 30*c* amplifies the outut from the amplifier 26 to produce an amplified negative output. This negative output is supplied to the allotter circuit 32 where it passes through the diode 32*f* to the terminal 106. Thus the negative output is developed across the terminals 106 and 100.

As seen in FIGS. 3 and 4, the negative output developed across the terminals 106 and 100 is supplied to the control winding 76*c* of each magnetic amplifier 76 disposed in the firing control circuit 34 on the power running side. Therefore a firing signal is produced across each pair of output terminals 50K and 50G, 52K and 52G or 54K and 54G as shown in FIG. 4 in the manner well known in the art and applied to the associated thyristor 50, 52 or 54 across the gate and cathode electrodes. Thus the thyristors 50, 52 and 54 effect the phase control of an AC voltage from the source R-S-T in response to the respective firing angles to supply the phase controlled AC voltage across the motor 20.

In this way the thyristors 50, 52 and 54 are controlled in accordance with the differential signal as above described and a voltage applied across the motor 20 is gradually increased to accelerate the motor 20. This acceleration of the motor 20 causes the acceleration of the elevator car 10 through the sheave 14. Then the tachometer generator 18 generate a speed signal representing the actual speed of the motor 20 and therefore the car 10 which speed is called is an "on full-load descending speed signal" $V_{td}$.

Under these circumstances the command speed signal $V_p$ and the on full-load descending speed signal $V_{td}$ are changed with time as shown in FIG. 6A. FIG. 6A also shows an on full-load ascending speed signal $V_{tu}$ as a function of time.

Further FIG. 6B illustrates the output from the substracter 24 or the differential signal between the command and actual speed signals plotted in ordinate against time in abscissa. In FIG. 6B curved labelled $V_{du}$ depicts a differential signal for the elevator car 10 ascending under full loading and curve labelled $V_{dd}$ depicts a differential signal for the car 10 descending under full loading.

Assuming that the contact set 28*h* is closed at time point $T_o$ (see FIG. 6B) during the particular acceleration, a circuit traced from the source 28*k* through the output limitings relay winding 28*i*, the normally closed contact set 28*fa* of the difference sensor relay 28*f*, the now closed contact set 28*h* and the closed contact set 28*j* of the running relay (not shown) and thence back to the source 28*k* is completed to energize the winding of the output limiting relay 28*i*. This energization of the relay 28*i* winding causes the closure of its contact sets 28*ia* and 28*ib*. The closures of the contact set 28*ia* results in the self-holding of the circuit as above described.

On the other hand, the closure of the contact set 28*ib* causes the output from the saturation generator 30 or the operational amplifier 30*c* thereof to be limited to a lower magnitude as above described. Therefore the firing angle of each thyristor 50, 52 or 54 on the power running side becomes smaller than that associated with the contact set 28*ib* maintained in its open position resulting in a decrease in AC voltage applied across the motor 20.

When driven adjacent to its synchronous speed with its rated voltage, the induction motor 20 produces a torque shown at curve $T_1$ in FIG. 7 wherein the torque is plotted in ordinate against the number of rotation in unit time of the motor in abscissa. In FIG. 7 curve $T_2$ describes a torque produced by the motor having applied thereacross a voltage less than the rated voltage, for example, one half the latter or a half voltage.

Therefore with the contact set 28*ib* brought into its closed position, the motor produces a torque such as shown at curve $T_2$ in FIG. 7 and the acceleration thereof is completed following a gradually decreased end portion of an acceleration curve $AC_2$ shown in FIG. 6C wherein the acceleration of the motor is shown as a function of time. This gives a person or persons within the elevator car 10 a good ride, at the end of the acceleration of the car.

On the other hand, with the rated voltage continuously applied thereacross, the acceleration of the motor 20 reaches a null value while it is oscillating as shown at dotted curve $AC_1$ in FIG. 6C.

If the travelling car 10 reaches a point where it should be initiated to be stopped then the command speed generator 22 produces a command speed signal for braking. Thus causes the output from the allotter circuit 32 to appear across the output terminals 108 and 100 thereby to control the firing control circuit 38 and therefore the thyristor device 40 on the braking side. Therefore a DC braking is applied to the motor 20 which need not be described in detail because it is not directly pertinent to the present invention.

When the elevator car 10 is upwardly travelling under full loading, the actual ascending speed signal $V_{du}$ is greater than $V_r$ at time point $T_o$ (see FIG. 6B). Accordingly the output from the subtractor 24 is of a large negative value. In this case the comparator or the operational amplifier 28*c* of the sensor circuit 28 receives a negative input and provides a positive output. This positive output causes the energization of the difference sensor relay 28*f* resulting in the opening of its contact set 28*fa*.

Under these circumstances, the closure of the contact set 28*h* midway of the particular acceleration of the motor 20 does not lead to the energization of the output limiting relay 28*i*. Therefore the output from the saturation generator 30 is not limited. This means that the closure of the contact set 30*f* midway of the acceleration permits the full firing of the thyristor device 36 on the power running side regardless of the output from the amplifier 26. Therefore the motor 20 is applied with its rated voltage until the acceleration thereof is completed.

Figure 8:
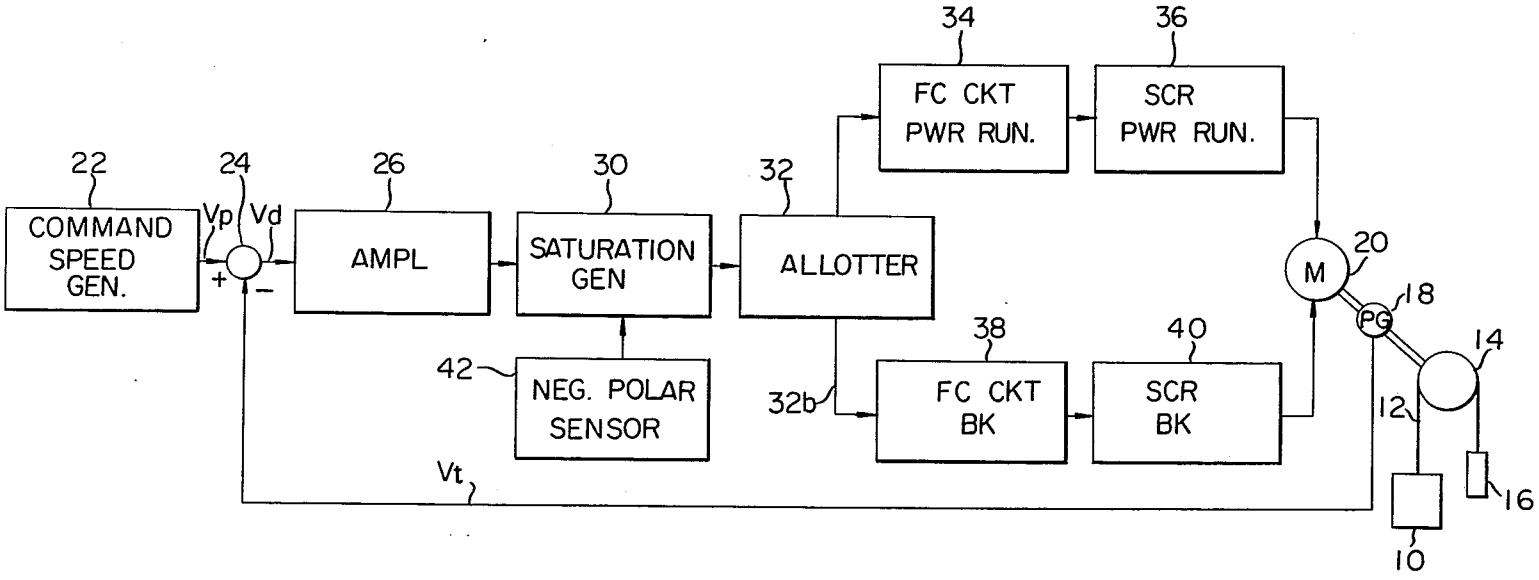
FIG. 8 is a block diagram similar to FIG. 1 but illustrating a modification of the present invention.
Figure 9:
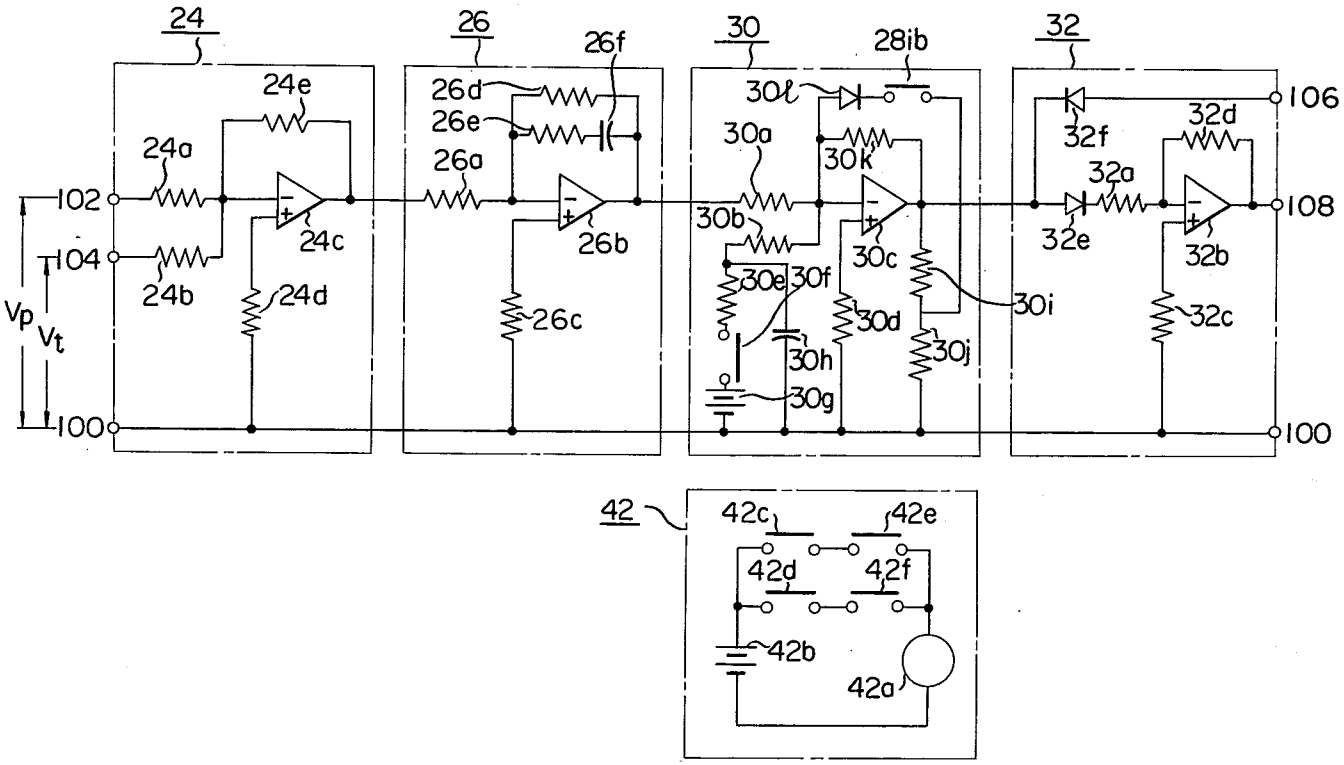
FIG. 9 is a diagram similar to FIG. 3 but illustrating the arrangement shown in FIG. 8.

A modification of the present invention is shown in a block diagram of FIG. 8 and the details thereof are illustrated in FIG. 9. In FIGS. 8 and 9 like reference numerals and characters have been employed to identify the components corresponding or similar to those shown in FIG. 1 and FIG. 3 respectively.

The arrangement illustrated in FIGS. 8 and 9 is different from that shown in FIGS, 1, 2 and 3 only in that in FIGS. 8 and 9 a sensor circuit 42 for sensing a negative polarity of a load on the motor 20 is substituted for the sensor circuit 28 for sensing a differential signal between a command speed signal and the actual speed signal. The polarity sensor circuit 42 is operatively coupled to the saturation generator 30 alone and responsive to a load on the motor 20 having a negative polarity and exceeding a predetermined magnitude to produce an output serving to limit the output from the saturation generator 30.

As shown in FIG. 9, the sensor circuit 42 comprises an output limiting relay having an energizing winding 42*a* connected across a source of direct current 42*b* through a series combination of a set of normally open contacts 42*c* and a set of normally open contacts 42*e* and also through a series combination of a set of normally open contact 42*d* and a set of normally open contacts 42*f*.

The contacts sets 42*c* and 42*d* are controlled by a sensor relay (not shown) for sensing an inner load borne by the elevator car 10 so that the contact set 42*c* is closed in response to the inner load equal to or higher than a predetermined magnitude, for example, 80% of the rated load of the car 10 while the contact set 42*d* is closed in response to the inner load equal to or less than a predetermined magnitude, for example, 20% of the rated load of the car 10. The contact set 42*e* is controlled by a downward running relay (not shown) adapted to be energized during the down travel of the elevator car 10 and the contact set 42*f* is controlled by an upward running relay (not shown) adapted to be energized during the upward travel of the car 10.

The output limiting relay is operative to sense that load of the motor 20 having a negative polarity caused from the particular inner load borne by the car 10 and direction of travel of the elevator car 10 and exceeding a predetermined magnitude to be energized resulting in the closure of its normally open contacts 42*aa* connected in the saturation generator 30 instead of the contacts 28*ib* shown in FIG. 3.

It is assumed that the elevator car 10 bears an inner load not less than 20% of its rated load and less than 80% thereof. Under the assumed condition the contacts sets 42*c* and 42*d* are maintained in their open position and the output limiting relay has its winding 42*aa* remaining deenergized and hence its contact set 42*aa* held in their open position. Therefore, upon starting the motor 20, the arrangement as shown in FIGS. 8 and 9 is operated in the same manner as above described in conjunction with FIGS. 1 through 7 and in terms of the downward travel of the elevator car 10 under full loading.

It is assumed that the elevator car 10 bears an inner load not less than 80% of its rated load and is downwardly travelling. Under the assumed condition under which the car 10 is said to be descending under full loading, the contact sets 42*c* and 42*e* are put in their closed position. Thus the relay winding 42*aa* is energized from the source 42*b* through the now closed contact sets 42*c* and 42*e* resulting in the closure of the contact set 42*aa*. Alternatively when the elevator car 10 bears an inner load less than 20% of its rated load and is upwardly travelling that is to say, when the car 10 is said to be ascending under null loading, the contact sets 42*d* and 42*f* are put in their closed position. Therefore the relay winding 42*a* is similarly energized from the source 42*b* to close the contact set 42*aa*.

The closure of the contacts 42*aa* causes the output from the saturation generator 30 or its comparator 30*c* to a lower magnitude as above described in conjunction with FIG. 3. Then the blocks 32, 34 and 36 are operated with that limited output and in the same manner as above described in the previous Figures until the acceleration of the motor 20 is completed while a more comfortable ride is given at the end of the acceleration as in the arrangement shown in FIGS. 1, 2 and 3.

From the foregoing it will be seen that in the arrangement as shown in FIGS. 8 and 9, the motor is applied with its rated voltage prior to the completion of the acceleration thereof for a load thereof having a positive polarity while a voltage applied across the motor 20 is limited to a lower magnitude for its load having a negative polarity.

It will readily be understood that the arrangement as shown in FIGS. 8 and 9 is identical in braking operation to that illustrated in FIGS. 1 through 3.

Thus it can be seen that the present invention has provided an elevator speed control system giving a good ride in an elevator car involved upon the completion of the acceleration thereof by limiting a voltage applied across an induction motor driving the car midway of the acceleration of the motor in response to either a differential signal between a command speed signal and the actual speed signal less than a predetermined magnitude or a load on the motor having a negative polarity to smooth a change in torque produced by the motor.

While the present invention has been illustrated and described in conjunction with a few preferred embodiments thereof it is to be understood that numerous changes and modifications may be resorted to without departing from the spirit and scope of the present invention.

What we claim is:

1. An elevator speed control system comprising, in combination, an elevator car and a counterweight connected to both ends of a traction rope respectively, a hoist sheave having said traction rope trained thereover, an induction motor for driving said hoist sheave to vertically move said elevator car and said counterweight in the opposite directions, and means for applying to said induction motor a voltage dependent upon a differential signal between a command speed signal for the motor and a speed signal representative of the actual speed of the motor, to accelerate the latter and applying a rated voltage across said motor after the completion of the acceleration of the motor, wherein there is provided a sensor circuit for sensing a negative polarity load on said induction motor to limit a voltage applied across said induction motor through the operation the sensor circuit.

2. An elevator speed control system as claimed in claim 1, wherein said sensor circuit is responsive to said differential signal less than a predetermined magnitude during the acceleration of the induction motor to be operative to limit the voltage applied across the motor.

3. An elevator speed control system as claimed in claim 1 wherein said sensor circuit is responsive to a load on said induction motor having a negative polarity and exceeding a predetermined magnitude to be operative to limit the voltage applied across the motor.

4. An elevator speed control system comprising, in combination, an elevator car and a counterweight connected to both ends of a traction rope respectively, a hoist sheave having said traction rope trained thereover, an induction motor for driving said hoist sheave to vertically move said elevator car and said counterweights in the opposite directions, a source of alternating current for driving said induction motor, thyristor means on the power running side and thyristor means on the breaking side connected between said induction motor and said source respectively, speed generator means operatively coupled to said induction motor to generate a speed signal representative of the actual speed of the latter, command generator means for generating a command speed signal for the induction motor, subtracter means connected to both said command generator means and said speed generator means to generate a differential signal between said speed signal and said command speed signal, saturation generator means coupled to said subtracter means to generate a command for saturation signal required for applying across the induction motor a rated voltage thereof after the completion of the acceleration of the induction motor, said saturation generator means being responsive to the initiation of deceleration of the induction motor to render said command for saturation signal null, sensor means connected to said subtracter means and operatively coupled to said saturation generator means to produce an output in response to said differential signal less than a predetermined magnitude to limit an output from said saturation generator means, firing control circuit means on the power running side operatively coupled to said saturation generator means to respond to said differential signal having a positive magnitude to control a firing angle of said thyristor means on the power running side to cause said source to apply across said induction motor an AC voltage phase controlled by said thyristor means on the power running side, and firing control circuit means on the braking side operatively coupled to said saturation generator means to respond to said differential signal having a negative magnitude to control a firing angle of said thyristor means on the braking side to cause said source to apply across said induction motor a DC voltage phase controlled by said thyristor means on the braking side.

5. An elevator speed control system comprising, in combination, an elevator car and a counterweight connected to both ends of a traction rope respectively, a hoist sheave having said traction rope trained thereover, an induction motor for driving said hoist sheave to vertically move said elevator car and said counterweights in the opposite directions, a source of alternating current for driving said induction motor, thyristor means on the power running side and thyristor means on the braking side connected between said induction motor and said source respectively, speed generator means operatively coupled to said induction motor to generate a speed signal representative of the actual speed of the latter, command generator means for generating a command speed signal for the induction motor, subtracter means connected to both said command generator means and said speed generator means to generate a differential signal between said speed signal and said command speed signal, saturation generator means coupled to said subtracter means to generate a command for saturation signal required for applying across the induction motor a rated voltage thereof after the completion of the acceleration of the induction motor, said saturation generator means being responsive to the initiation of deceleration of the induction motor to render said command for saturation signal null, negative polarity load sensor means operatively coupled to said saturation generator means to produce an output in response to a load on said induction motor having a negative polarity and exceeding a predetermined magnitude to limit an output from said saturation generator means, firing control circuit means on the power running side operatively coupled to said saturation generator means to respond to said differential signal having a positive magnitude to control a firing angle of said thyristor means in the power running side to cause said source to apply across said induction motor an AC voltage phase controlled by said thyristor means on the power running side, and firing control circuit means on the braking side operatively coupled to said saturation generator means to respond to said differential signal having a negative magnitude to control a firing angle of said thyristor means on the braking side to cause said source to apply across said induction motor a DC voltage phase controlled by said thyristor means on the braking side.

* * * * *